United States Patent [19]

Schron

[11] 4,398,819

[45] Aug. 16, 1983

[54] COMBINATION SCROLL AND MARQUEE DISPLAY

[75] Inventor: Steven M. Schron, Fairport, N.Y.

[73] Assignee: Xerox Corporation, Stamford, Conn.

[21] Appl. No.: 344,086

[22] Filed: Jan. 29, 1982

[51] Int. Cl.[3] ..... G03G 15/00

[52] U.S. Cl. ..... 355/14 R; 355/14 CU; 340/815.16; 340/713; 340/716

[58] Field of Search ..... 355/14 R, 14 CU, 14 C, 355/3 R, 55; 340/366 R, 366 A, 366 B, 365 R, 365 VL, 166 EL, 706, 713, 715, 716, 718; 364/518

[56] References Cited

U.S. PATENT DOCUMENTS

| | | | |
|---|---|---|---|
| 3,958,239 | 5/1976 | Green | 340/365 R |
| 3,971,013 | 7/1976 | Challoner et al. | 340/337 |
| 4,035,072 | 7/1977 | Deetz et al. | 355/14 |
| 4,158,886 | 6/1979 | Gray, Jr. et al. | 364/518 |
| 4,251,769 | 2/1981 | Ewert et al. | 340/715 X |
| 4,264,188 | 4/1981 | Tomosada et al. | 355/55 X |
| 4,327,994 | 5/1982 | Barley et al. | 355/14 R |
| 4,343,547 | 8/1982 | Nagashima | 355/14 R |

OTHER PUBLICATIONS

IBM Technical Disclosure Bulletin, vol. 18, No. 10, 1976.

Laid Open Dutch Application No. 74.11641.

*Primary Examiner*—A. C. Prescott

*Attorney, Agent, or Firm*—Ronald F. Chapuran

[57] ABSTRACT

A control and an alphanumeric display in a reproduction machine for selectively displaying to an operator messages in either a normal, scroll or marquee fashion to simplify and assist operator interaction with the machine. In particular, a plurality of operator messages are stored in the read only memory in the control. Upon the need to display operator messages during the operation of the machine, the control decodes a specific code associated with the particular message and in response to the code selectively activates a mode of display, either normal, marquee or scroll, for the particular message.

13 Claims, 6 Drawing Figures

CPB
68
76
SWITCH YARD CONNECTOR
78
SWITCH YARD
CPB CONNECTOR
70
72
DC/TTL OUTPUT CONNECTOR
74
A.C. OUTPUT CONNECTOR
EXPANSION I/O PORT CONNECTOR
BCB
60
I/O BOARD CONNECTOR
64
63
POWER CONNECTOR
65
SW. INPUT CONNECTOR
67
SENSOR INPUT CONNECTOR
POWER CONNECTOR
60
MCB
58
BATTERY CONNECTOR
62

96
ADDRESS
Ad/DATA
CHIP SELECT DECODE
94
88
INTR
RST 6.5
RST 7.5
RST 5.5
RDY
80a
80b
80c
82
ROM
ROM
ROM
RAM
CLK OUT
86
T. WAIT WRITE GEN
NSPWR
RAM 2K NVM
84
CHIP SELECT
POWER NORMAL SENSE
NRSTin
TRAPin
85
90
MCB OUTPUTS
MCB INPUTS
92
98
RTC
WDT
BAUD 300
÷10
÷10
÷16
÷16
÷10
÷10
25 %
50 %

COMBINATION SCROLL AND MARQUEE DISPLAY

This invention relates to a reproduction machine and in particular to a reproduction machine having a combination scroll and marquee alphanumeric display.

Prior art reproduction machines such as disclosed in U.S. Pat. Nos. 4,035,072 and 4,158,886, assigned to the same assignee as the present invention, generally show the control of complex reproduction machines. In particular, these patents generally teach the concept of various operator controls including push buttons and displays on an operator control console. Other systems such as disclosed in U.S. Pat. Nos. 3,971,013 and 3,958,239 disclose touch operated keyboards or switch plates that can be coupled to a computer or matched to information displayed on a CRT tube.

Other prior art systems provide for operator interaction with the reproduction machine and provide orderly sequences of messages displayed to the operator to assist in the operation and control of the machine. For example, U.S. patent application Ser. Nos. 89,429 now U.S. Pat. No. 4,300,829 and 89,433 filed Oct. 30, 1979 limit the number of instructions or messages displayed at any one time and guide the operator through a step by step sequence of displayed messages. Other systems such as disclosed in IBM Technical Disclosure Bulletin, Volumn 18, No. 10, 1976, show a program control of information entry for a reproduction machine. In particular, the control panel is divided into entry program and display sections for interactions between the operator and the reproduction machine. The entry portion, for example, might progressively ask for job number, light or dark originals, reduction size, or duplex operation. Numerical information is then entered or a yes or no key is activated in response. Other systems such as shown in Laid Open Dutch Application Ser. No. 74.11641 teaches the use of a diagnostic display unit with an instruction screen and circuit to display the highest priority machine condition.

Other prior art systems such as disclosed in pending application Ser. No. 153,642 filed May 27, 1980 now U.S. Pat. No. 4,327,994 and assigned to the same assignee as the present invention, disclose the use of a machine function selection message display instructing the operator to actuate predetermined console keys to select a desired machine function. It also discloses the means responsive to the actuation of the switch or keys to condition the machine to operate according to the operator selected function and to cause the display to indicate another function selection message.

The difficulty with these prior art systems is often the cost of the components and the complexity of the control. Another difficulty with prior art devices is in the manner of display. Generally, reproduction machine displays provide information in a scroll fashion, that is, there is a discrete display in sequence of portions of a message. This often restricts flexibility in the type of messages to be displayed.

It is also known in the prior art to display information in a marquee fashion. That is, there is a continuous rotation in a display of a particular message, the displaying capacity often being less than the length of the message to be displayed. These type of displays, although offering the advantage of a repetitive display, often are difficult to understand if the particular message is lengthy, compared with the display. In some instances a scrolled message would be preferred.

It is an object of the present invention, therefore, to provide a machine display that is versatile and inexpensive and provides the flexibility of displaying messages in either a scroll fashion or a marquee fashion, depending upon the nature of the display and the effect upon the operator.

Further advantages of the present invention will become apparent as the following description proceeds, and the features characterizing the invention will be pointed out with particularity in the claims annexed to and forming a part of this specification.

Briefly, the present invention is concerned with a control and an alphanumeric display in a reproduction machine for selectively displaying to an operator messages in either a normal, scroll or marquee fashion to simplify and assist operator interaction with the machine. In particular, a plurality of operator messages are stored in the read only memory in the control. Upon the need to display operator messages during the operation of the machine, the control decodes a specific code associated with the particular message and in response to the code selectively activates a mode of display, either normal, marquee or scroll, for the particular message.

For a better understanding of the present invention, reference may be had to the accompanying drawings wherein the same reference numerals have been applied to like parts and wherein FIG. 1 is an elevational view of an electrophotographic machine employing the present invention;

Figure 1:
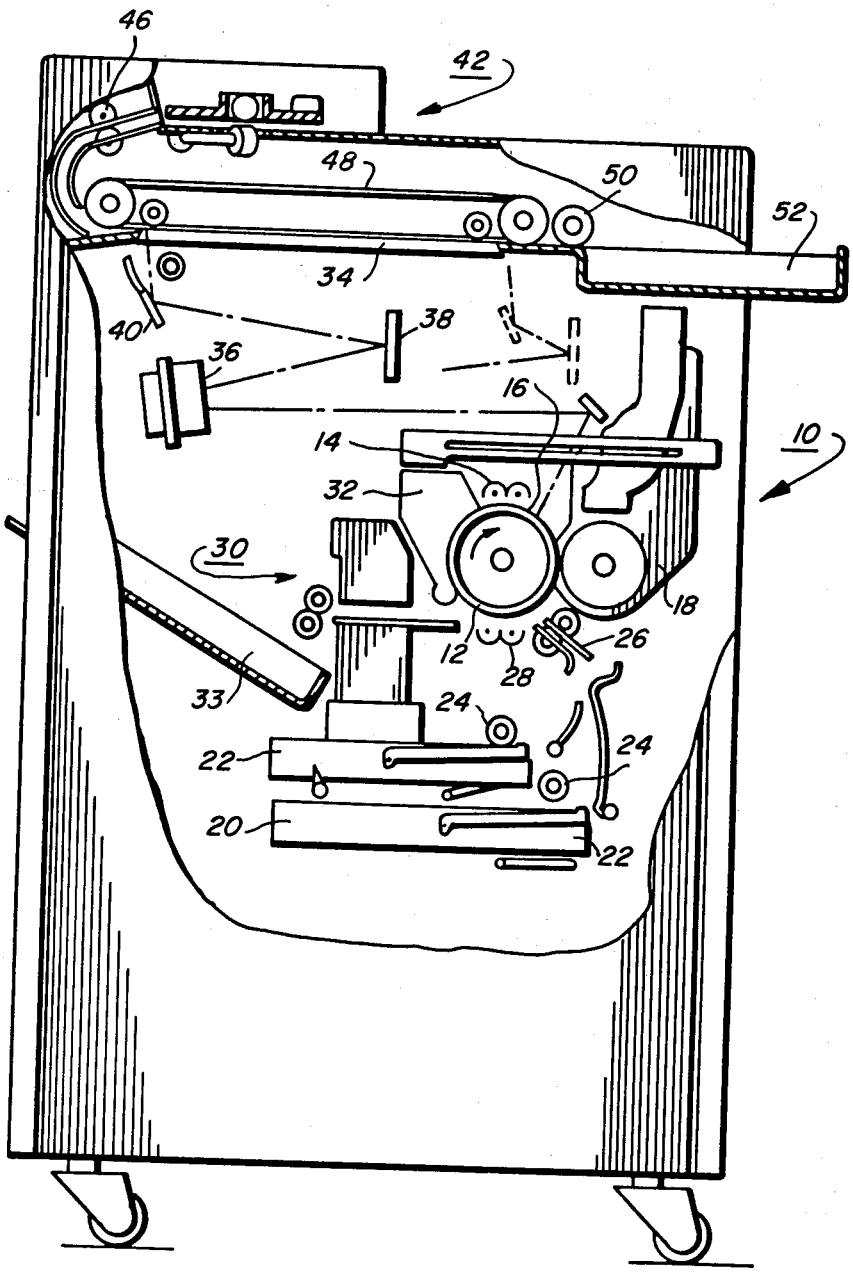

Referring now to FIG. 1, there is shown by way of example, a reproduction machine 10 incorporating the present invention. In particular, the reproduction machine 10 includes an image recording drum-like member 12 having its outer periphery coated with a suitable photoconductive material. The drum rotates in the direction of the arrow to bring the image bearing surface past a plurality of xerographic processing stations.

Initially, the drum 12 moves the photoconductive surface through a charging station 14 providing an electrostatic charge uniformly over the photoconductive surface. Thereafter, the drum 12 is rotated to exposure station 16 and the charged photoconductive surface is exposed to a light image of the original document to be reproduced. After exposure drum 12 rotates the electrostatic latent image recorded on the photoconductive surface to development station 18 wherein a conventional developer mix is applied to the photoconductive surface of the drum 12 rendering the latent image visible. Typically, a suitable development station could include a magnetic brush development system utilizing a magnetizable developer mix having coarse ferromagnetic carrier granules and toner particles.

Sheets 20 of the copy paper are supported in a stack arrangement on elevating stack support trays 22. With a stack at its elevated position, a sheet separator 24 feeds individual sheets therefrom to the registration system 26. The sheet is then forwarded to the transfer station 28 in proper registration with the image on the drum. The developed image on the photoconductive surface 13 is brought into contact with the sheet 20. At transfer station 28, the toner image is transferred from the photoconductive surface to the contacting side of the copy sheet 20.

After the toner image has been transferred to the copy sheet 20, the copy sheet 20 with the image is advanced to a suitable fusing station 30 for coalescing the transferred powder image to the support material. After the fusing process, the copy sheet 20 is advanced to a suitable output device such as tray 33.

Residual toner particles remaining on the photoconductive surface 13 after the transfer operation are removed from the drum 12 as it moves through a cleaning station 32. Normally, when the copier is operated in a conventional mode, the original document to be reproduced is placed image side down upon a horizontal transparent platen 34 and the stationary original then scanned by means of a moving optical system. The scanning system includes a stationary lens 36 and a pair of cooperating movable scanning mirrors, half rate mirror 38 and full rate mirror 40 supported upon suitable carriages.

A document handler 42 can also be provided including pinch rolls 46 activated to feed a document around 180° curved guides into the platen 34 for copying. The document is driven by a platen belt transport including platen belt 48. After copying, the platen belt 48 is activated and the document is driven off the platen by the output pinch roll 50 into the document catch tray 52.

Figure 2:
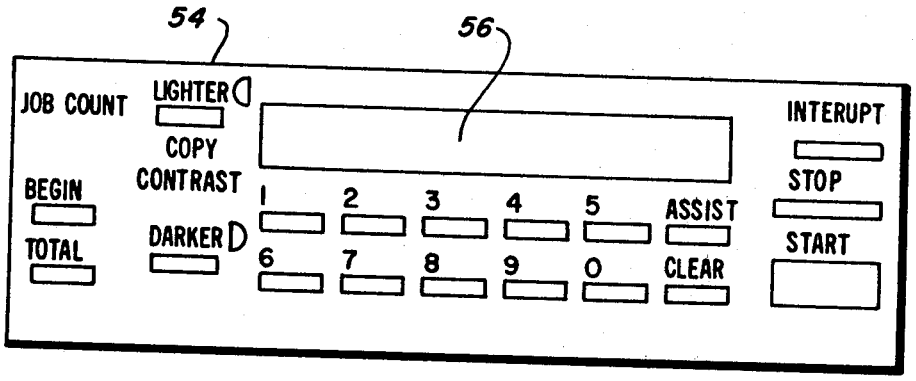
FIG. 2 is a top plan view of the operator console including display for assisting operator control of the machine according to the present invention.

With reference to FIG. 2, there is shown the operator control panel 54, in particular including a 20 character, 16 segment, alphanumeric display 56. The control panel 54 also includes 10 numeric keys and other switches such as start, stop, assist, clear, copy contrast, job count, the end, and total switches. In addition, there are switches for interrupt, copy lighter and copy darker with associated LED's.

Figure 3:
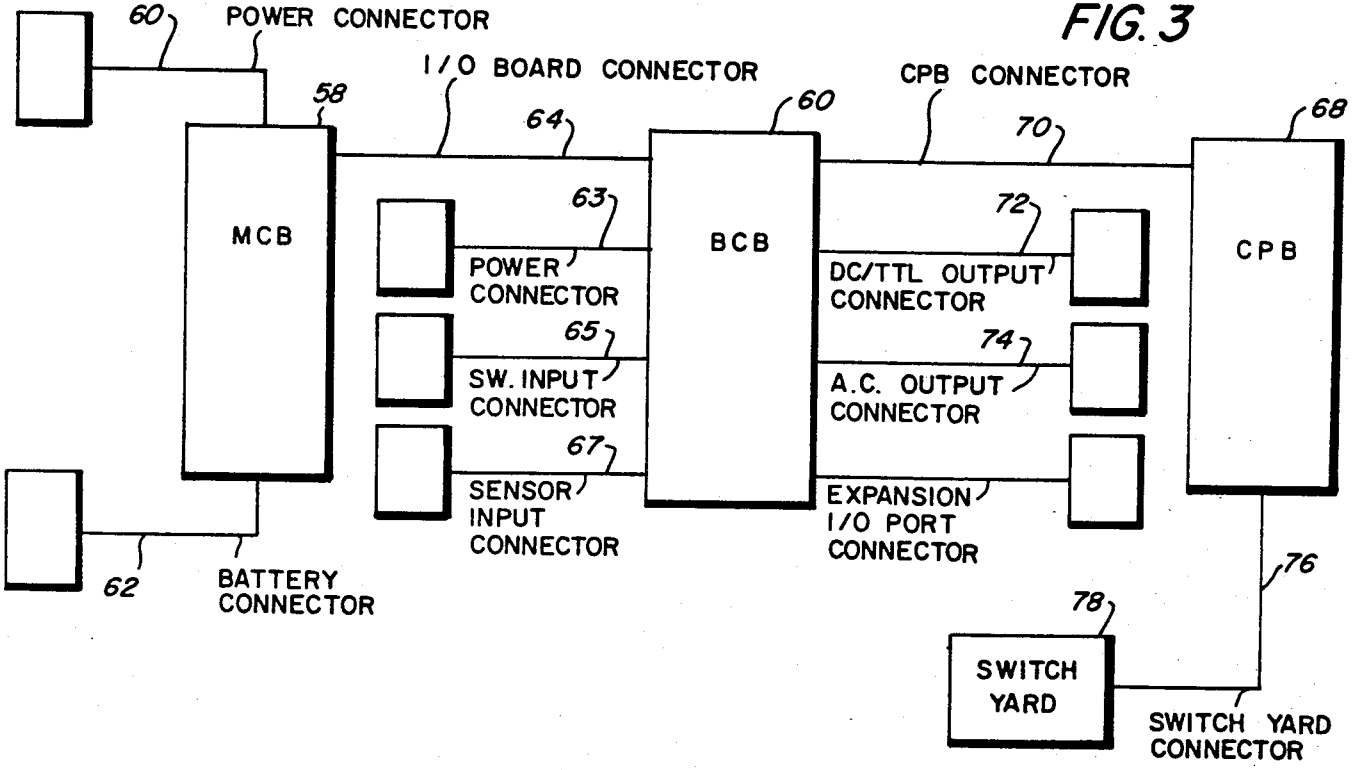
FIG. 3 is a general block diagram of the control of the machine illustrated in FIG. 1.

With reference to FIG. 3, there is shown a general block diagram of the control for the reproduction machine illustrated in FIG. 1. In particular, there is shown a master control board 58 interconnected to a power connector 60 and a battery connector 62. An I/O board connector 64 connects the master control board 58 to a base control board 60. The base control board 60 is connected to a power connector 63, a switch input connector 65 and a sensor input connector 67. The switch input connector 65 and sensor input connector 67 connect the base control board 60 to the various switches and sensors in the reproduction machine illustrated in FIG. 1 to receive inputs from the various switches and sensors. The base control board 60 is also interconnected to a control panel board 68 through a control panel board connector 70. The base control board 60 also provides outputs to the various components of the reproduction machine as shown in FIG. 1, through a DC output connector 72 and an AC output connector 74. The control panel board 68 is interconnected through a connector 76 to a switch yard or switch matrix 78 for receiving input from the operator control panel 54.

The master control board 58 is the central control for the machine. The base control board 60 is an extension of the master control using buffered address and data buses. The base control board 60 contains all the machine input buffers and output/driver triacs. The control panel board 68 is an extension of the base control board 60 to handle the control panel 54 input and output. It is interfaced by a buffered addressed/data bus, and the master control board 58 microprocessor will scan inputs and refresh the twenty character alphanumeric display 56 on the control panel 54.

Figure 4:
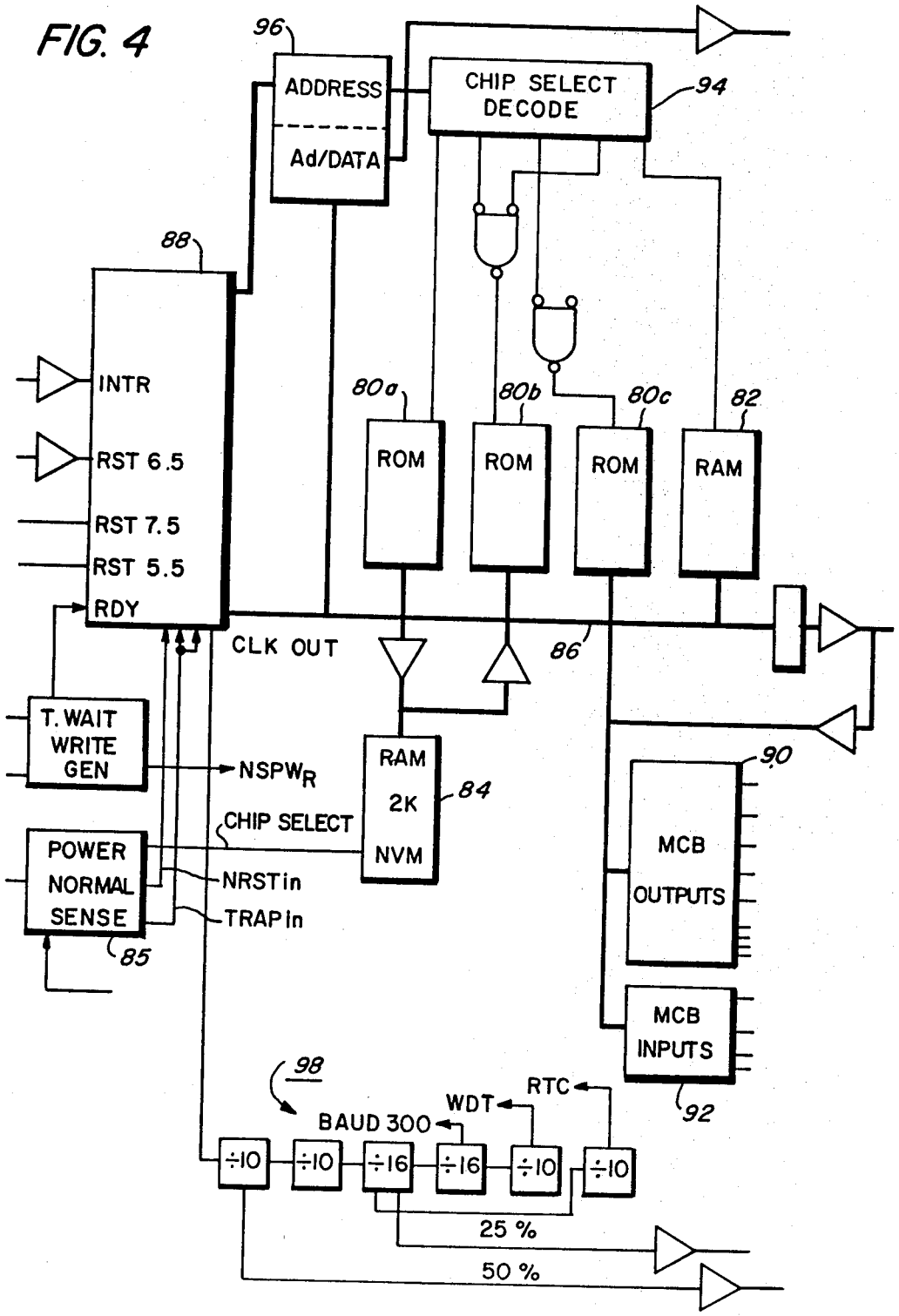
FIG. 4 is a detailed schematic of the master control board of the control of the present invention and FIGS. 5*a* and 5*b* are a detailed schematic of the control panel board of the machine shown in FIG. 1 according to the present invention.

With reference to FIG. 4, the master control board 58 includes suitable ROM 80A, 80B, 80C, RAM 82 and nonvolatile NVM 84 memories. The memories are connected to a suitable internal bus 86, in turn connected to a microprocessor 88, preferably an Intel 8085. The bus 86 is preferably an eight bit bus, also interconnected to output logic 90 and input logic 92.

ROMS 80A and 80B contain the system operating instructions and the ROM 80C contains various message sets capable of being displayed on the display 56 to aid in the machine operation. The RAM 82 is any suitable read/write memory and the memories 80A, 80B, 80C and 82 are connected through suitable chip select decode circuitry 94 to address logic 96. The nonvolatile memory 84 is also interconnected to the bus 86 and to a suitable battery. Suitable support logic circuitry is generally shown at 98 and provides various signals such as 300 baud rate signal, i.e. WDT 34 millisecond signal, and a real time clock RTC 519 microsecond signal to provide the various timing signals for operation of the machine. The RTC signal and BAUD 300 signal provide interrupts to the master control board, in addition to zero cross interrupt.

The nonvolatile memory 84 contains information on the status of the machine. This information can be displayed on the twenty character display 56 on panel 54. A power normal sensor detector 85 monitors decreases in power to initiate switching battery power to the non-volatile memory 84.

Figure 5A:
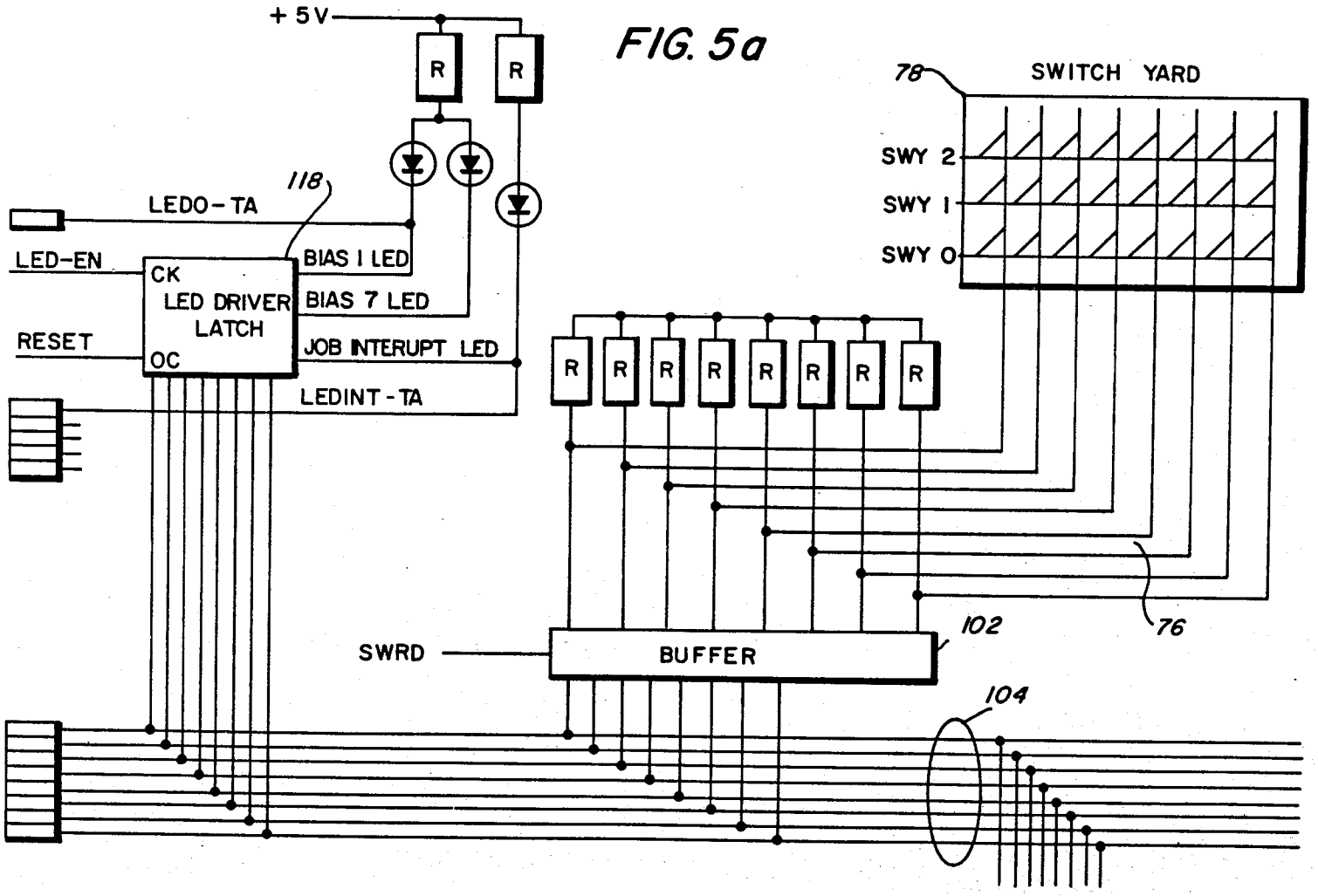
Figure 5B:
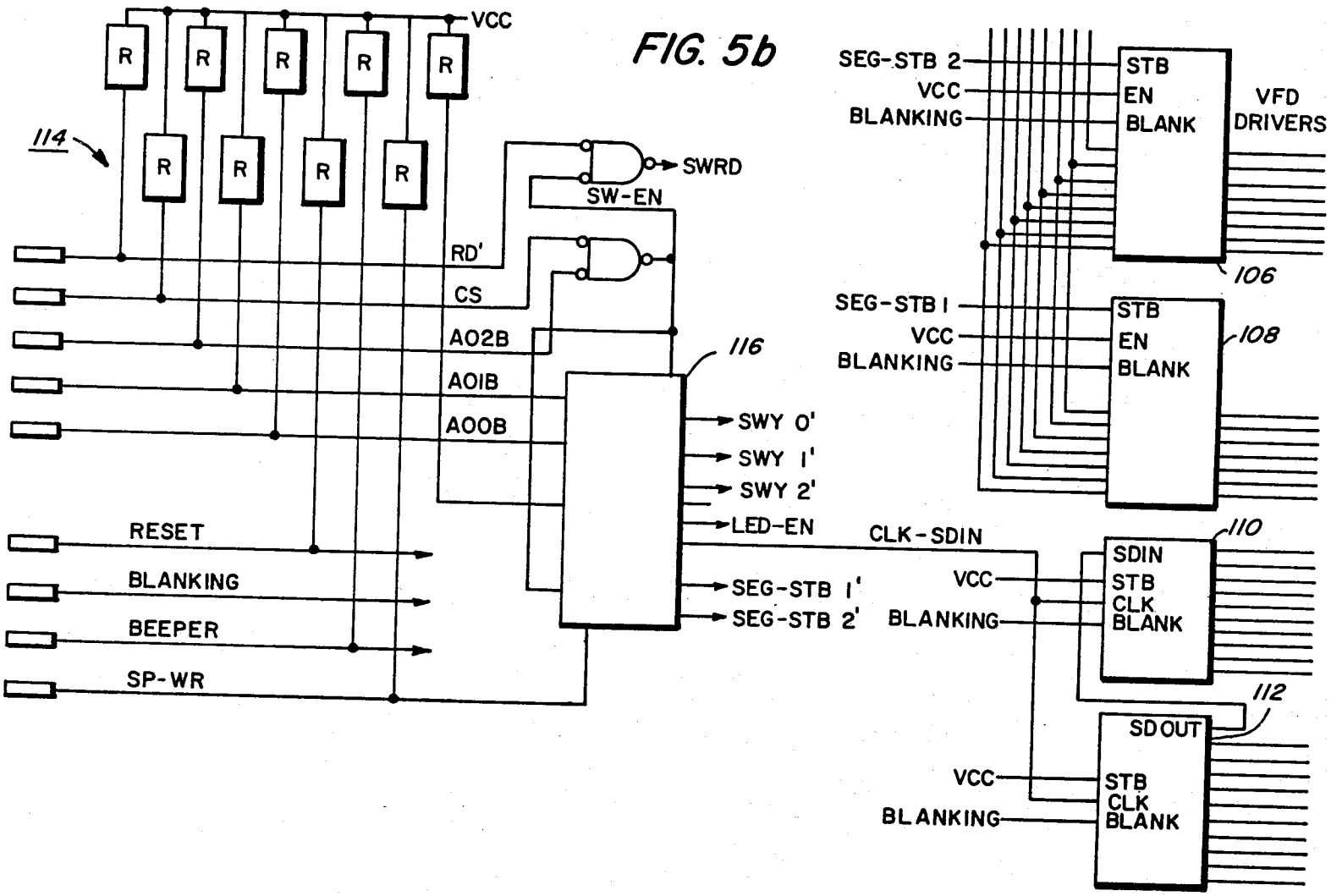

With reference to FIGS. 5*a* and 5*b* there is shown the control panel board in detail. In particular, the switch yard or matrix switch 78 is interconnected to the control panel board through a switch yard connector 76 and buffer 102. The switch yard 78 is preferably a three by eight switch matrix providing 19 switch functions. The buffer 102 is connected to an internal bus 104, the internal bus 104 in turn connected to the control panel board connector 70 as seen in FIG. 3.

Two VFD segment drivers 106 and 108 are connected to the bus 104. Two other VFD character drivers 110 and 112 are connected to decode circuitry generally shown at 114 through logic 116. The four VFD drivers 106, 108, 110 and 112 drive the display 56. Other circuitry such as the LED driver latch 118 connected to the bus 104 activates various LEDs on the control panel 54.

In accordance with the present invention, messages can be displayed on the alphanumeric display 56 in normal, marquee, or in a scroll fashion. The messages listed below are typical messages for the display of the reproduction machine.

| | |
|---|---|
| 1 | @01 ***** ZAP |
| 2 | @03 READY TO MAKE 1 COPY WITH (PAP SIZ) PAPER TO MAKE MORE THAN 1 COPY – SELECT REQUIRED NUMBER |
| 3 | @02 (CPY SEL) COPIES SELECTED!PRESS START TO RUN |
| 4 | @01 ***** RUNNING |
| 5 | @01 DARKER COPY SELECTED |
| 6 | @01 LIGHTEN COPY SELECTED |
| 7 | @03 COPIER CAN NOT MAKE MORE THAN 200 |

-continued

| | |
|---|---|
| | COPIES AT ONE TIME SEPERATE INTO 2 OR MORE JOBS |
| 8 | @01 ***** SADH JAM |
| 9 | @01 ***** OPTICS JAM |
| 10 | @02 FIRST JOB IN MEMORY!COPIER READY TO RUN |
| 11 | @03 CONTINUE FIRST JOB BY PRESSING START |
| 12 | @01 ***** PAPER PATH JAM |
| 13 | @01 ***** SADH JAM |
| 14 | @01 ***** DOR OPEN |
| 15 | @03 CHECK FOR MISFED PAPER OR OUT OF PAPER CONDITION |
| 16 | @03 COPIER WILL NOT RUN UNLESS KEY COUNTER IS INSERTED IN SLOT IN CONTROL PANEL |
| 17 | @01 ***** LOW TONER |
| 18 | @01 ***** SORTER JAM |
| 19 | @01 ***** OUTPUT JAM |
| 20 | @02 PLEASE WAIT!COPIER WARMING UP!READY IN X MINUTES! |
| 21 | @02 TO CLEAR PAPER JAM!OPEN FRONT COVER!REMOVE PAPER! |

In those messages exceeding 20 characters in which there is no exclamation point, the messages are displayed in a marquee fashion. That is, the message is continuously rotated through the display. In those messages where there is an exclamation, the message is to be scrolled, the exclamation point segregating separate segments of the message. For example, messages 5 and 6, DARKER COPY SELECTED and LIGHTEN COPY SELECTED are less than 20 characters in length. Therefore, they are displayed normally. That is, the entire message is displayed at one time. On the other hand, message 3 is scrolled. That is, the message display first displays X COPIES SELECTED and then the display is replaced by the message PRESS START TO RUN. Message 7 is marqueed, that is, continuously rotated.

The type of message, whether normal, marquee or scroll, is identified by a code in front of the message. For example, the code 01 identifies a normal message. This code identifies just a single panel or short message that is displayed as a complete message. The code 02 identifies a message to be scrolled and the exclamation point breaks up the message into its scrolled segments. Each segment is a given length up to 20 characters and is displayed a given length of time, for example, 500 milliseconds. After 500 milliseconds, the second character segment is displayed for 500 milliseconds.

An 03 code signifies the message to be marqueed. That is, a given number of characters, for example, the first 20 characters of the message are displayed. After a given period of time, for example 300 milliseconds, the message is shifted one character. The control will therefore display characters 2 through 21 of the message. This process will repeat, that is, characters 3 through 22, 4 through 23 . . . continually shifting and repeating the message. It should be noted that it is within the skill of the art to provide other codes for various display techniques.

To display a message, the controller identifies the code and the type of message and then jumps to a specific routine to display the particular identified message in the correct fashion. For example:

-continued

```
Message Type Control;
  Read Message Type;
  If Message Type = @01 Then
      DO;
          Start Normal Message Display
      END;
  If Message Type = @02 Then
      DO;
          Start Scroll Message Display
      END;
  If Message Type = @03 Then
      DO;
          Start Marquee Message Display
      END
Typical display routines for normal, scroll and marquee
are as follows:
Normal Display routine; (Type @01)
      Read characters till @;
      Move characters into display buffer;
End Normal Display routine;
Marquee Display routine; (Type @03)
START:  Set Message Pointer to Start of Message;
LOOP:   Read 20 characters starting at Message Pointer;
        If last character = @ GO TO START;
        Move 20 characters to display buffer;
        Wait 300 MS;
        Increment Message Pointer;
        GO TO LOOP;
End Marquee Display routine;
Scroll Display Routine; (Type @02)
START:  Read characters from start of message till !;
LOOP1   Move characters to display buffer;
        Wait 500 MS;
        Read characters till @ or !;
        If last character = !GO TO LOOP1;
        GO TO START;
End Scroll Display Routine;
```

The instructions as indicated are stored in ROM memory 80C. Once the controller identifies that a certain message is to be displayed in a certain fashion, the message is conveyed from the ROM memory 80C to the control panel board 68 via the input/output board connector 64 and the CPB connector 70. The message is conveyed in the CPB 68 along the bus 104 to activate the drivers controlling the display 56.

Preferably, the display is under control of software. For example, in a marquee display, a software pointer will point to the first set of 20 characters of the message and display them. After a given period of time, the pointer jumps to the second character and gives the next set of 20 characters to the display. This sequence is continually repeated to constantly rotate the message through the display. In effect, there is a software shift register to continually move 20 characters through the display window.

In the case of a scrolled message, the pointer will identify the first set of characters of the message, although the first segment may not completely fill the display. After a given time lag, the pointer will identify the first character of the second set of characters to be displayed.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

What is claimed is:

1. In a reproduction machine for producing impressions of an original, the combination of a photosensitive member, a plurality of discrete operating components cooperable with one another and a photosensitive member to electrostatically produce the impressions on support material, an operator console having an alphanumeric display, a controller including a memory electronically storing the characters for providing messages, means to display the messages in either a scroll or marquee manner on the alphanumeric display, means to select a particular message for display, identification means to determine the manner of display of the particular selected message, and means to display the particular message in response to the identification means.

2. The combination of claim 1 wherein the memory is a read only memory having a predetermined message set.

3. The combination of claim 1 wherein the means to display messages in either a scroll or a marquee manner includes the means to continually shift a given number of characters through the alphanumeric display until all the characters of the message have been displayed including the means to repeat the shifting process, and the means to display a first segment of a particular message for a specific period of time and the means to display successive segments of a particular message after the display of the first segment for said given period of time.

4. The combination of claim 1 wherein the identification means includes the means to identify a given code associated with each message to determine the display of the message in either a scroll or a marquee manner.

5. In a reproduction machine having machine components including an operator console with an alphanumeric display and having a control provided with a plurality of stored electronic messages including identifiers, a method of operating the machine including the steps of selecting a particular message for display, decoding the indentifier to determine whether the message is to be displayed in either a scroll, marquee, or normal manner, and displaying the particular message in either a scroll, marquee, or normal manner on the alphanumeric display in response to the determination.

6. The method of claim 5 including the step of displaying the message by continually shifting the message through the alphanumeric display until the entire message has been displayed.

7. The method of claim 6 including the steps of displaying characters 1 through 20 of the message, next displaying character 2 through 21 of the message, and continually shifting the image through the display in 20 character increments.

8. The method of claim 5 wherein the messages are comprised of blocks of characters including the step of displaying the message by displaying a first segment of the message on the display for a first period of time and then displaying a second segment of the message for a second period of time, the first and second segments comprising independent blocks of characters together providing a total message.

9. The method of claim 5 including the step of recognizing a first identifier and providing a first routine for displaying the message in a marquee fashion and recognizing a second identifier and providing a second routine for displaying the messages in a scroll fashion.

10. In a reproduction machine having machine components including an operator console with an alphanumeric display and having a control provided with a plurality of stored electronic messages including identifiers, the identifiers indicating a particular mode of display, a method of operating the machine including the steps of selecting a particular message for display, decoding the identified to determine the mode of display for that particular message, and displaying the particular message on the alphanumeric display in response to the determination.

11. The method of claim 10 wherein one mode of display is to successively display partial segments of the total message in discrete steps.

12. The method of claim 10 wherein one mode of display is to continuously shift the message through the display.

13. The method of claim 12 wherein characters 1 through 20 of the message are displayed, characters 2 through 21 are next displayed, and the sequence is repeated shifting one character at a time until the entire message is displayed.

* * * * *